United States Patent [19]

Warshaw

[11] 3,983,997

[45] Oct. 5, 1976

[54] YARN PACKAGE AND METHOD FOR MIXING AND DISPENSING

[75] Inventor: Saul Warshaw, Hawley, Pa.

[73] Assignee: Atlantic Gummed Paper Corporation, Brooklyn, N.Y.

[22] Filed: Nov. 18, 1975

[21] Appl. No.: 633,094

Related U.S. Application Data

[63] Continuation of Ser. No. 484,312, June 28, 1974, abandoned.

[52] U.S. Cl. ..... 206/389; 53/30 S; 206/392; 206/410; 206/413; 206/414; 206/497; 206/813

[51] Int. Cl.[2] ..... B65B 53/00; B65D 65/14; B65D 85/67; B65H 55/02

[58] Field of Search ..... 53/30, 32; 206/389, 206/392, 407, 409, 410, 413, 414, 497, 813; 229/DIG. 12; 242/159, 171–173

[56] References Cited

UNITED STATES PATENTS

| | | | |
|---|---|---|---|
| 1,937,468 | 11/1933 | Talbot | 242/172 |
| 3,260,358 | 7/1966 | Gottily et al. | 206/410 |
| 3,399,761 | 9/1968 | Hayashi | 206/392 |
| 3,669,255 | 6/1972 | Raymus | 206/497 |
| 3,700,185 | 10/1972 | Hubbard et al. | 242/171 |
| 3,731,792 | 5/1973 | Rolston | 206/407 |

*Primary Examiner*—William Price
*Attorney, Agent, or Firm*—Curtis, Morris & Safford

[57] ABSTRACT

A package of filamentary yarn in the form of a wound cake of successive layers of the yarn, as may be produced by a forming winder, has an unlined hollow core. The lead end of the yarn extends for unwinding drafting of the yarn from the interior of the cake and the yarn tail end extends from the cake exterior. A heat-shrunk plastic film cover surrounds the sides of the cake from one end to the other so as to form a package therewith and a supporting doughnut shaped bumper ring is provided which has a transverse footing face of appreciable lateral area upon which the package may be stably supported upright. This supporting ring may be anchored to the lower cake end section by the film cover or may be secured to the cover in any suitable manner. A similar doughnut shaped bumper ring may be provided to fit over the other end of the cake for shipping.

19 Claims, 8 Drawing Figures

YARN PACKAGE AND METHOD FOR MIXING AND DISPENSING

This is a continuation, of application Ser. No. 484,312, filed June 28, 1974, now abandoned.

The present invention relates to packages of filamentary yarns and more particularly to packages of filamentary yarns in the form of a wound cake of the yarn.

Heretofore many problems have been encountered in making shippable forming packages or "cakes" of filamentary yarns, particularly of glass fiber yarns.

These cakes are made by winding the filamentary glass fiber on a rotating mandrel or collet. The problem arises in shipping these cakes of glass fiber yarns because typically the cakes are formed with feathered edges which are easily damaged in handling and transport. The nature of some yarns, particularly glass fiber yarns, is such that despite a high tensile strength, damage is readily inflicted on the unprotected yarn by abrasion.

To aviod damage to the yarn it has heretofore been the practice to twist the glass fiber yarn while simultaneously winding it on a bobbin. The bobbin is typically a cylindrical shaft member fixed within a circular base plate.

This process is inordinately cumbersome and expensive as complex yarn twisting machinery must be employed and the bobbins must be returned to the yarn producer after use for rewinding so that additional shipping costs are incurred.

In addition the twisting operation necessary when bobbins are used damages the yarn slightly and the twisted yarn is not as desirable as non-twisted yarn in certain applications, for example as reinforcement in reinforced paper tape.

An additional factor which must be considered in preparing cakes of glass fiber yarn is the necessity often to provide cakes where the tail end of one cake can be bonded to the lead end of another cake. This may be necessary where a continuous unwinding operation is desired. Ideally, snagging or snarling of the yan which would tend to cause abrasion of the yarn and breakage to disrupt continuous operation must be avoided.

Various proposals for shippable forming packages of yarn have been made heretofore. One example of such a package is U.S. Pat. No. 3,260,358 to Gotilly et al in which a cake of yarn is shown wound up on a forming winder collet core tube, in a shape featuring frustoconical cake ends. The core tube is left in place within the wound cake and the latter is dropped into a heat-shrinkable, plastic film envelope that has a hole in its bottom through which one projecting end of the core tube extends. After heat-shrinking of the envelope about the cake and sides of the core tube projecting ends there are no exits for the yarn lead and tail ends to permit yarn unwinding without stripping off the heat-shrunk envelope or cover. For this purpose the envelope is provided with weakened longitudinal tear lines and pull tabs on the envelope walls to facilitate such stripping. Yarn removal may involve a costly intermediate practice of yarn twisting including transfer to a twist bobbin or undesirable yarn drafting from the cake exterior which hazards the rubbing of the drafted yarn against the cake. Such rubbing of glass fiber yarn frequently causes filaments thereof to fracture so as to promote yarn unraveling and resultant breakage.

Another proposal is shown in U.S. Pat. No. 3,109,540 to Klimpl. This patent shows making cakes of yarns or rovings of glass fibers, etc. by winding them into cylindrical rolls having flat transverse ends. Each of such cylindrical roll cakes, which have unlined hollow cores, may be housed in a heat-shrunk plastic film bag, with both of the lead end of the yarn or roving extending from the hollow core and the tail end extending from the roll exterior out through the bag mouth. A special shipping cardboard carton is provided for a plurality of cakes with each cake being linked to the next for continuous unwinding. No provision is made in Klimpl to preclude tangling or snarling of the yarn when one of the cakes has been unwound to the outermost winding.

Another package of filamentary yarn is shown in U.S. Pat. No. 3,382,971 to Johnson. This patent shows a complete housing of a cylindrical ball of hay baling twine within a cover consisting of a cup-shaped heat-shrunk plastic receptacle, that is formed from a cylindrical bag, and a label carrying closure disk of cardboard of the twine ball diameter located inside of the mouth of this heat-shrunk bag with the annular edge of the latter turned over to clamp the cardboard disk against a flat end of the twine ball. A central hole is provided in the cardboard disk through which the lead end of the twine is to be pulled from the open core wall of the cylindrical twine ball.

U.S. Pat. No. 3,399,761 to Hayashi is also concerned with the packaging of a generally cylindrical yarn cake which is wound up on a tubular core tube in a forming winder. End disks are provided of foamed plastic and central holes therein snugly receive ends of the core tube to provide the equivalent of a spool about which the cake of yarn is wound between the spool end disks. A heat-shrunk sleeve of plastic is snugly provided about the side surfaces of the spool and the cake carried thereby, with end zones of the sleeve cover laid over outer radial zones of the outside end faces of the spool disks by heat shrinkage to bind all parts together. Another form of the Hayashi package provides the cake ends with shallow crowns or convex faces and the spool end disks have their inner faces shallowly concaved to fit such cake end convex surfaces. There is no indication that the lead and tail ends of the yarn of any of the Hayashi cakes are disposed other than as being hidden respectively between the cake hollow core wall and the core tube and between the heat-shrunk cover and the cake exterior without access to either. The heat-shrunk cover is said to be removable by tearing away, but no removal of the core tube is proposed.

SUMMARY OF THE INVENTION

The present invention provides desirable advantages over all such prior art by equipping in an economical manner the type of yarn cakes which are cylindrical in shape such as those illustrated in U.S. Pat. No. 3,109,540 to Klimpl or which have frustoconical end sections at both ends; such as those illustrated in U.S. Pat. No. 3,258,116 to Goerke, U.S. Pat. No. 3,259,235 to Sowle and U.S. Pat. No. 3,260,358 to Gottily et al. For each embodiment bumper rigns are preferably provided for the ends and for the cakes having frustoconical ends the central hole in each ring is defined by a frustoconical wall, i.e., a socket, into which the frustoconical cake end section securely nests. Such nesting rings for each such yarn cake preferably is formed or molded economically from relatively rigid and lightweight foamed plastic, e.g., polystyrene. This bumper ring minimizes bump and collision damage to the cake yarn in handling and shipping. The ring also has a transverse footing face on its bottom side that is of appreciable lateral area upon which the package may be stably supported upright. Protectively this yarn cake is provided with a heat-shrunk, plastic film cover, which may be of polystyrene or other similar heat-shrinkable plastic. The lead end of the yarn is disposed for ready withdrawal from a point on the wall of the hollow core opening which extends along the axis of the cake through the tip ends of the latter, for continued drafting of the yarn from the cake interior. One bumper ring is preferably anchored for convenient availability to the cake lower end section that is nested therein by means of this heat-shrunk cover.

Another object of the present invention is to protect in a simple manner the relatively fragile tapered feather edges of the tip ends of frustoconical cake end sections from handling and shipping abrasive damage by simple, but effective guarding thereof through use of protective bumper and nesting rings and, additionally, by having the mating socketing surfaces of such rings relieved at locations adjacent the frustoconical end of the cake.

An additional object of the present invention is to eliminate the need for twisting fiber glass yarn and the attendant requirement as well as added cost of winding it on a bobbin preceding use.

A further object of the present invention is to provide simple means of temporarily adhering in an easy peel-away manner turns of the yarn in the exterior of the cake to inner faces of a heat-shrunk protective cover so that such turns may be removed in orderly and properly successive fashion from the interior out through the open top end of the cover to minimize the tendency of the unwinding yarn to snarl and bunch and thus interfere with desirable continuous free running.

Still further objects of the invention are to improve in economical manners the packaging, distribution and handling of yarns of glass fibers which avoids problems of proneness of the brittle fibers to be fractured by abrasive action in conventional handling. It is also desirable to eliminate the need for yarn twisting so that it remains naturally flat which is desirable for some uses, and to eliminate the former limitations as to sizes of packages.

A still further object of the present invention is to provide yarn cakes in which the tail may be transferred readily from one cake to the leading end of another cake.

Figure 1:
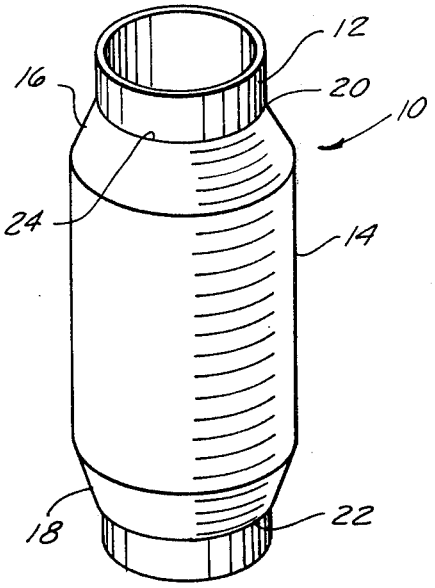
FIG. 1 is a perspective view of one preferred form of yarn cake as wound up on the core tube of a forming winder during assembly of the cake.

As is illustrated in FIGS. 1 and 4 to 6, a cake 10 of wound yarn produced by a forming winder which winds successive layers upon a removable forming tube 12 is shown. In this embodiment a plurality of such layers are laid down successively with the layers being of progressively lesser widths. As a result, the cake 10 is formed with a substantially cylindrical mid-section 14 which is flanked on opposite ends by frustoconical end sections 16 and 18. With this structure oriented in the manner illustrated in FIG. 1 and FIGS. 4 and 6 the uppermost frustoconical end section 16 may be considered the top end of the cake which terminates in a transverse tip end 20. The lowermost frustoconical end section 18 likewise terminates in a transverse tip end 22.

Preferably the removable core tube 12 is formed from paperboard or it may be formed from relatively thin plastic tubing, but in any event it can readily collapse longitudinally for withdrawal from the center of the cake 10 of yarn after the cake is formed so as to provide an empty hollow core opening 24 extending axially through the cake.

Since the yarn cake 10 is to be provided with a suitable cover, its innermost layer which is first laid down about the forming tube 12 includes the leading end 26 of the yarn. The leading end is adjacent the removable forming tube before its withdrawal and extends therefrom during preparation of the yarn cake 10. The tailing end 28 of the yarn is located on the exterior of the yarn cake and also extends from the cake after winding. The leading and trailing ends of the yarn are secured to the exterior of the cake as will be explained more fully hereinbelow.

Figure 2:
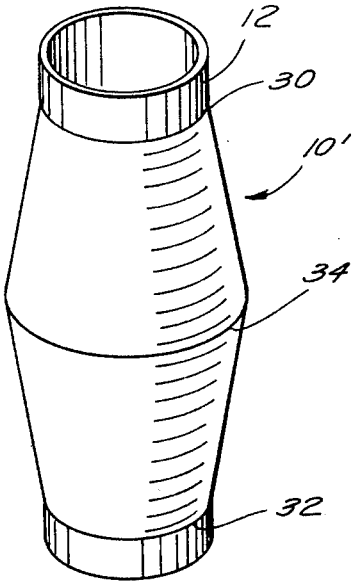
FIGS. 2 and 3 are views similar to FIG. 1 illustrating other shapes of yarn cakes producible by other winding equipment.

In the embodiment shown in FIG. 2, another type of cake 10′ is shown wherein the yarn is wound upon the forming tube 12 to provide a cake having a progressively increasing diameter from each end 30 and 32, respectively, to a maximum diameter at approximately the mid-plane 34 between the ends 30 and 32.

Figure 3:
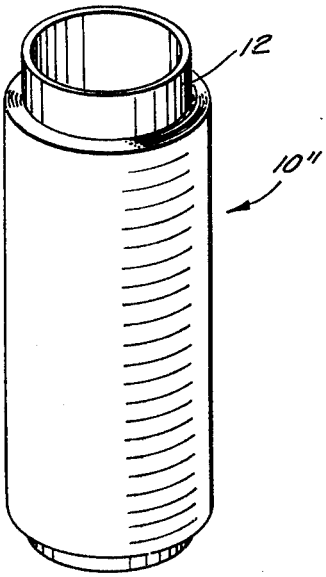

In FIG. 3, still another type of cake 10″ is shown which is wound on the forming tube 12 to provide a cake of substantially uniform diameter throughout so as to be substantially cylindrical in shape.

It is to be expressly understood that while the description of the present invention will be made with respect to the cake shape shown in FIG. 1, the invention is not restricted thereto but is equally applicable to other cake shapes such as those illustrated in FIGS. 2 and 3 as well.

In use, the yarn is withdrawn from the empty hollow core opening 24 of the cake 10 by continual drafting. When the cake of yarn is nearly exhausted, there will remain the outermost turns of the yarn located immediately adjacent inside surfaces of a heat-shrunk protective cover which ultimately, as the yarn of the cake becomes progressively depleted, will have insufficient support to maintain the orderly relative orientation of the yarn. This may cause yarn snarling which would tend to interfere with proper running of the yarn from the cake.

Such difficulty is readily avoided by providing peel-away adhesive means which temporarily anchors yarn on the exterior of the cake 10 to the interior of the protective cover while permitting yarn turns in the outer cake layers to be peeled away from the inside surfaces of this cover. Such peel-away adhesive means may be in the form of a thin coating of adhesive lightly sprayed on the exterior surfaces of the cake or in selected sections of such surfaces. Preferably, such peel-away adhesive means consists of a plurality of longitudinal, circumferentially spaced strips 36, which may be four in number and arranged at about 90° apart. For this purpose "3M No. 404 double pressure sensitive tape" manufactured by the Minnesota Mining and Manufacturing has been found to be suitable for such use.

Figure 4:
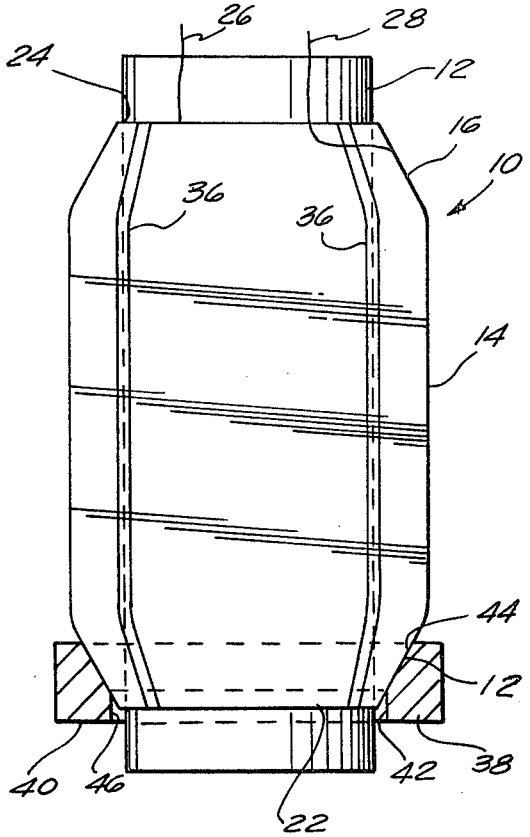
FIG. 4 is a side elevational view of the cake and core tube of FIG. 1 showing the addition thereto of strips of double-faced adhesive tapes and the nesting of the bottom end of the yarn cake within a doughnut shaped supporting ring.

After application of the adhesive strips 36, as is indicated in FIG. 4, the bottom frustoconical end section 18 of the yarn cake 10 is nested within a doughnut-shaped supporting bumper ring 38. Preferably, bumper support ring 38 is molded from foamed plastic, such as polystyrene, or similar moldable foaming plastic. The ring 38 is provided with a transverse footing face 40, which may be an annular flat surface of sufficient lateral area to stably support the cake upright. The nesting ring is also provided with an axial through hole 42 which is defined by a generally frustoconical surface 44 into which the lower frustoconical end section 18 of the cake 10 nests. As shown in FIG. 4, the transverse feather edge 22 of the yarn cake tip end does not have direct contact with the inner nesting surface 44 of the support ring 38 since this ring surface is intentionally relieved, as at 46, in the transverse plane of this edge so as to avoid contact with the feather edge.

Figure 5:
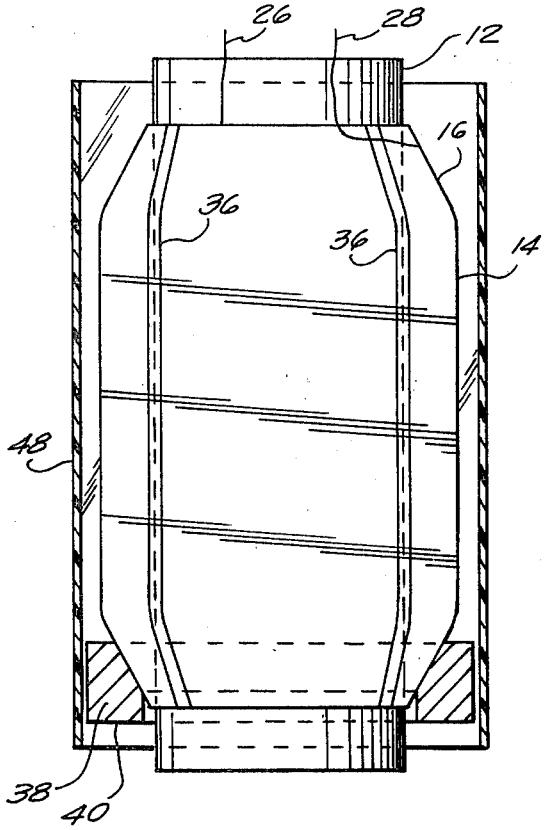
FIG. 5 is a side elevational view similar to FIG. 4 and adding thereto a section of heat-shrinkable plastic tubing that has been telescoped thereover.
Figure 6:
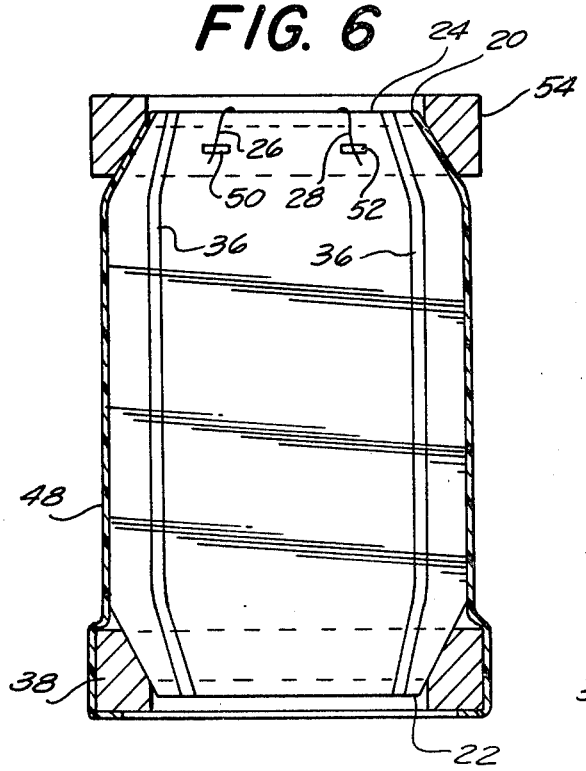
FIG. 6 is a side elevational view of parts shown in FIG. 5 after the heat shrinking of the plastic tubing to form a snug cover and the removal of the core tube which has been removed by collapse and withdrawal.

The cake 10 and nesting ring 38 are encased within a protective film cover, which may be a section of polyethylene tubing or other heat shrinkable plastic of similar characteristics. For this purpose, a segment of heat-shrinkable plastic tubing 48 is telescoped over cake 10 and ring 38 as is illustrated in FIG. 5. The plastic tubing is shrunk snugly about the cake 10 and nesting ring 38 by application of heat, for example by hot air in a shrink tunnel, to cause the film to contract tightly against the exterior surfaces of the cake and nesting ring in the manner illustrated in FIG. 6. The now tightly encasing cover 48 surrounds the cake to provide protection against abrasive damage in shipping and handling. The cover also anchors the ring 38 to the lower cake end section 18.

Preferably during fabrication of the cake 10 the yarn lead tail end 26 and, after winding is completed, the yarn trailing end 28 are maintained extending upwardly from the cake for retrival after the heat-shrink operation. After the plastic film cover 48 has been shrunk about cake 10, the forming tube 12 is collapsed and withdrawn leaving the hollow core opening 24. Following the collapse and withdrawal of the core tube 12, the yarn lead end 26 is folded down over the top end 20, draped back against the exterior surface of film cover 48 and fastened, as at 50, by any suitable means, such as a piece of pressure sensitive adhesive tape for ready access. In like manner, the yarn trail end 28 is draped against the exterior surface of film cover 48 and also fastened, as at 52, by a piece of pressure sensitive adhesive tape. Preferably different color adhesive tapes are used to designate the lead and trail ends.

To complete the package assembly, a top bumper support ring 54 which is similar in construction to ring 38 is placed over the top tip end 20 of the cake outside the heat-shrunk film cover 38 and, if desired, may be secured there in any suitable manner, for example by strips of pressure sensitive adhesive tape.

The readily separable top bumper ring 54 completes the protective package about the cake 10 to insure that in shipping and handling the cake is protected from damage. The top ring also makes it easier to stack a number of cakes, one atop another, for greater ease in handling. To use the cake of yarn, the top ring is readily removed and the lead 26 and trail 28 yarn ends are readily accessible by simply peeling away the attaching strips of adhesive tape.

A fabricator using yarn packaged in cakes of the present invention may link successive yarn cakes for certain production operations to maintain a continuous production run. In doing so, a pair of such packages may be supported in a creel with a yarn tail end of a first one of this pair tied or bonded in any suitable manner to the yarn lead end of the second package for continuous yarn drafting. This will permit the replacement of the empty cover of the first cake with another such cake and to tie the yarn lead end of the new cake to the yarn tail end of the second cake for further continued yarn drafting through a common guide eyelet or pigtail to the fabricating equipment.

Figure 8:
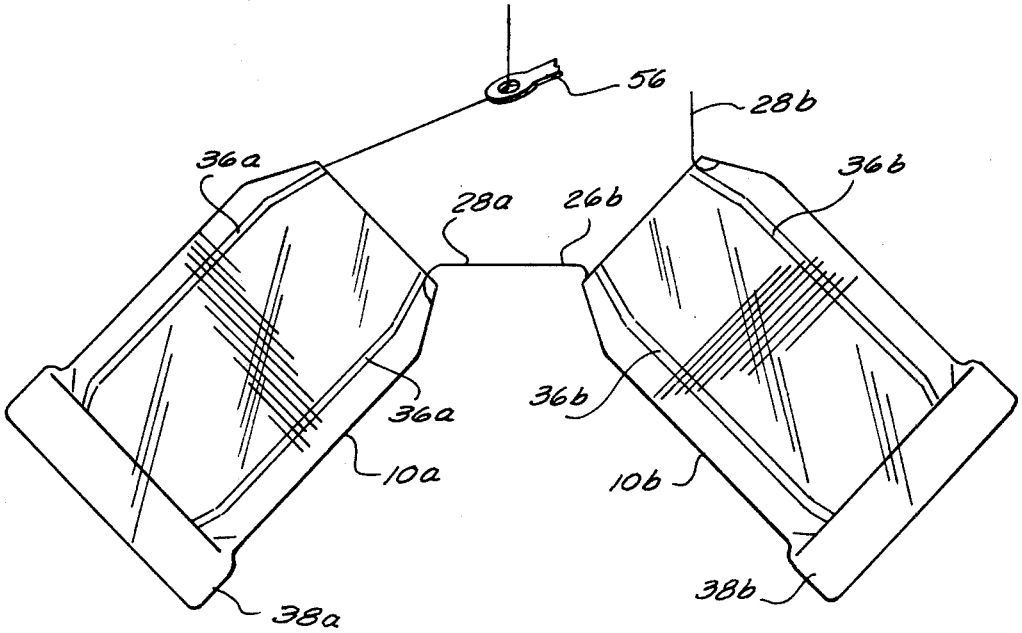
FIG. 8 is a diagramatic representation of two yarn cakes of the present invention arranged for continuous unwinding with the tail end of one cake bonded to the lead end of the second cake.

Reference is made to FIG. 8 where a pair of successive cakes **10*a* and 10*b* are shown supported with their axes oblique to each other and crossing substantially at the eyelet or pigtail 56. The lead end of the first cake 10*a* is threaded through the eyelet 56 to the production apparatus (not shown). The tail end 28*a* of cake 10*a* is bonded to the lead end 26*b* of cake 10*b* so that when cake 10*a* is exhausted the yarn is automatically drawn from cake 10*b*** without any interruption to continuous operation.

The orientation of the cakes **10*a* and 10*b* at an oblique angle insures that the feeding of yarn through eyelet 56, when the yarn supply shifts from cake 10*a* to 10*b***, does not produce a snarl or tangle which may cause abrasion and resultant fracture of the yarn.

As explained above, the use of spaced longitudinal adhesive strips 36 has the advantageous effect of precluding collapse of the outermost winding of the yarn as the yarn is unwound. If the yarn were to collapse, there is a tendency for the collapsed yarn to adhere together as a ball and to be drawn up in the tangled state to the eyelet 56. There the ball of collapsed yarn may tangle and snarl to a point where the yarn being drawn through the eyelet will rub against the eyelet and, as tension is increased, even break.

Figure 7:
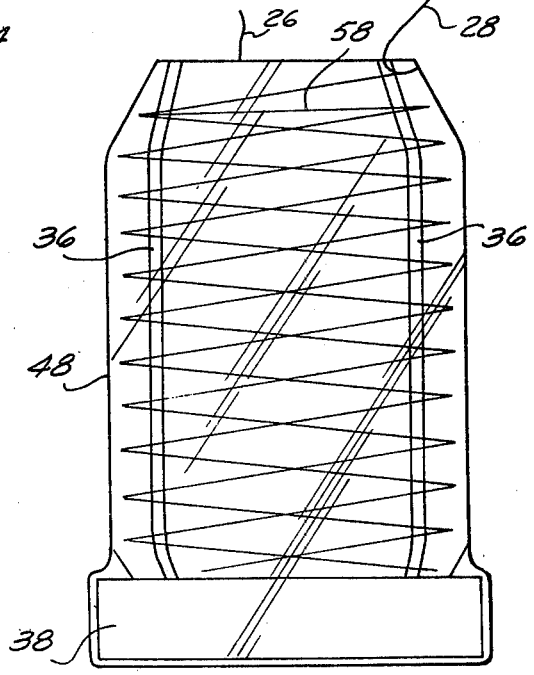
FIG. 7 is an elevational view showing the yarn cake after unwinding to the last layer of yarn.

However, the adhesive strips 36 retain the outermost winding of the yarn 58 (see FIG. 7) against the interior surface of the protective cover 48 to preclude collapse of the yarn. The adhesive bond between the outermost winding 58 and the tape strips 36 is sufficient to maintain continuous contact but is not great enough to offer a significant resistance to peeling off the yarn as it is pulled through the eyelet in a production run.

It is to be understood that while a preferred embodiment of the invention has been described wherein the lower bumper ring 38 is secured to the cake 10 by the heat-shrunk cover 48 an alternative construction for the cake is also contemplated. Such alternative constructive may comprise heat-shrinking the protective cover 48 about the cake 10 before placing the lower ring 38 about the cake and then securing the ring 38 and ring 54, if desired, to the cake exterior the cover 48.

It is thus seen that the present invention provides a unique shippable package of a yarn cake which protects the cake during shipping and handling from damage and which provides ready withdrawal of the yarn in use while precluding tangling or snarling of the yarn so that continuous yarn drafting between successive yarn cakes may be attained. Where continuous drafting from one cake to another is not required, the present invention still provides orderly withdrawal of the yarn to the very end of the cake. For such uses it is not necessary to make the yarn tail end 28 readily accessible and the yarn tail end may then be disposed beneath the outer protective cover 48.

It is also to be understood that while a preferred form for the bumper rings 38 and 54 is disclosed as a doughnut shape, other shapes and forms for this protective device may be used. Ideally the protective ring has an outer diameter slightly larger than the maximum diameter of the cake to prevent contact between adjacent cakes where a number of cakes are packaged in one container. The protective ring may also take the shape of a foamed plastic tray in which a plurality of nesting holes are provided to support a plurality of cakes. A similar top tray can also be utilized to provide a shipping means wherein a number of cakes may be secured.

The bumper rings or trays may also be designed with opposed nesting surfaces so that one ring or tray may have an end of one cake disposed in nesting relationship in one surface and an end of another cake disposed in nesting relationship in the opposed surface. In this way one ring or tray may accommodate opposite ends of two cakes within the same axial alignment.

What is claimed is:

1. A package of filamentary yarn comprising, a cake of wound yarn as may be produced by a forming winder which winds successive layers of yarn upon a removable forming tube thereby to form a yarn cake having a hollow core, said cake provided with adhesive means on the exterior of said cake, a bumper ring disposed about one end of said cake to form a protective cover for said one end of said package, a heat-shrunk plastic film cover surrounding the exterior surface of said cake and said ring to anchor said ring to said cake, the leading and trailing ends of said wound yarn cake being secured to the outside of said heat-shrunk film for ready accessibility for yarn drafting from said cake without removing said film, and said adhesive means temporarily bonding yarn on the exterior of said cake to the interior of said heat-shrunk cover thereby to permit the yarn turns in the outer cake layer to be pulled away from the inside surfaces of said cover while precluding collapse of the outermost yarn turns to prevent tangling and snarling during yarn drafting from said cake.

2. A package of filamentary yarn as defined in claim 1 including a second bumper ring disposed about the other end of said cake exterior said heat-shrunk cover thereby to form a protective cover for the said other end of said package.

3. A package of filamentary yarn as defined in claim 2 wherein each said bumper ring includes a transverse footing face of sufficient lateral area upon which said package may be stably supported.

4. A package of filamentary yarn as defined in claim 1 wherein said bumper ring is molded from foamed plastic.

5. A package of filamentary yarn as defined in claim 3 wherein said cake is formed with opposite frustoconical end sections with each terminating in a transverse tip end and each said bumper ring provided with an axial through hole defined by a generally frustoconical surface into which the frustoconical end of said cake nests.

6. A package of filamentary yarn as defined in claim 1 wherein said adhesive means comprises a plurality of circumferentially spaced and longitudinally disposed strips of double faced adhesive pressure sensitive tape.

7. A package of filamentary yarn as defined in claim 1 wherein said adhesive means comprises a coating of adhesive on the surface of said yarn cake.

8. A package of filamentary yarn comprising, a cake of wound yarn of successive layers of yarn formed to have an unlined hollow core from which yarn is drafted from the hollow core through successive layers of the yarn to the outermost layers of yarn, said cake being formed with opposite ends having a frustoconical shape terminating in a transverse tip tapered feather edge, adhesive means on the exterior surface of said cake, a protective ring member having a surface thereon complimentary to the surface of said frustoconically shaped transverse tip end of said yarn cake to receive said yarn cake end in protecting nesting relationship, a heat-shrunk plastic film cover surrounding the exterior surface of said yarn cake and the exterior surface of said protective ring thereby holding said ring in firm nesting relationship on said yarn cake end, the leading and trailing ends of said wound yarn cake being secured to the outside of said heat-shrunk film for ready accessibility for yarn drafting from said cake without removing said film, and said adhesive means bonding said heat-shrunk cover to the exterior surface of said yarn cake to preclude collapse of said yarn cake as yarn turns in the outermost layers of said cake are drafted.

9. A package of filamentary yarn as defined in claim 8 wherein said adhesive means comprises a plurality of circumferentially spaced and longitudinally disposed strips of double faced adhesive pressure sensitive tape.

10. A package of filamentary yarn as defined in claim 8 wherein said adhesive means comprises a coating of adhesive on the surface of said yarn cake.

11. A package of filamentary yarn comprising, a cake of wound yarn as may be produced by a forming winder which winds successive layers of yarn upon a removable forming tube thereby to form a yarn cake having a hollow core, said cake provided with adhesive means on the exterior of said cake, a bumper ring disposed about one end of said cake to form a protective cover for said one end of said package, a heat-shrunk plastic film cover surrounding the exterior surface of said cake and said ring to anchor said ring to said cake, said adhesive means temporarily bonding yarn on the exterior of said cake to the interior of said heat-shrunk cover thereby to permit the yarn turns in the outer cake layer to be pulled away from the inside surfaces of said cover while precluding collapse of the outermost yarn turns to prevent tangling and snarling during yarn drafting from said cake, a second bumper ring disposed about the other end of said cake exterior and said heat-shrunk cover thereby to form a protective cover for the said other end of said package, each said bumper ring including a transverse footing face of sufficient lateral area upon which said package may be stably supported, said cake being formed with opposite frustoconical end sections with each terminating in a transverse tip end and each said bumper ring provided with an axial through hole defined by a generally frustoconical surface into which the frustoconical end of said cake nests, and wherein said through hole in said bumper ring is relieved to preclude contact with the transverse end of said cake.

12. A package of filamentary yarn comprising, a cake of wound yarn of successive layers of yarn formed to have an unlined hollow core from which yarn is drafted from the hollow core through successive layers of the yarn to the outermost layers of yarn, said cake being formed with opposite ends having a frustoconical shape terminating in a transverse tapered feather edge, adhesive means on the exterior surface of said cake, a protective ring member having a surface thereon complimentary to the surface of said frustoconically shaped transverse tip end of said yarn cake to receive said yarn cake end in protecting nesting relationship, a heat-shrunk plastic film cover surrounding the exterior surface of said yarn cake and the exterior surface of said protective ring thereby holding said ring in firm nesting relationship on said yarn cake end, said adhesive means bonding said heat-shrunk cover to the exterior surface of said yarn cake to preclude collapse of said yarn cake as yarn turns in the outermost layers of said cake are drafted, and said complimentary surface in said protective ring member being relieved in the area adjacent the feathered tip end of said yarn cake to preclude contact with said tip end with said ring in nesting relationship on said yarn cake.

13. A package of filamentary yarn comprising, a cake of wound yarn as may be produced by a forming winder which winds successive layers of yarn upon a removable forming tube thereby to form a yarn cake having a hollow core, said cake provided with adhesive means on the exterior of said cake, a heat-shrunk plastic film cover surrounding the exterior surface of said cake, said heat shrunk cover completely covering all exposed portions of said wound yarn cake, a bumper ring disposed about one end of said cake exterior said cover to form a protective cover for said one end of said package, at least one of the ends of said wound yarn cake being secured to the outside of said heat-shrunk film for ready accessibility for yarn drafting from said cake without removing said film, and said adhesive means temporarily bonding yarn on the exterior of said cake to the interior of said heat-shrunk cover thereby to permit the yarn turns in the outer cake layer to be pulled away from the inside surfaces of said cover while precluding collapse of the outermost yarn turns to prevent tangling and snarling during yarn drafting from said cake.

14. A package of filamentary yarn comprising, a cake of wound yarn as may be produced by a forming winder which winds successive layers of yarn upon a removable forming tube thereby to form a yarn cake having a hollow core, said cake provided with adhesive means on the exterior of said cake, a bumper ring disposed about one end of said cake to form a protective cover for said one end of said package, a heat-shrunk plastic film cover surrounding the exterior surface of said cake and said ring to anchor said ring to said cake, at least one of said ends of said wound yarn cake being secured to the outside of said heat-shrunk film for ready accessibility for yarn drafting from said cake without removing said film, and said adhesive means temporarily bonding yarn on the exterior of said cake to the interior of said heat-shrunk cover thereby to permit the yarn turns in the outer cake layer to be pulled away from the inside surfaces of said cover while precluding collapse of the outermost yarn turns to prevent tangling and snarling during yarn drafting from said cake.

15. A method of forming a filamentary yarn cake comprising, winding yarn to form a cake of yarn about a removable forming tube, orienting the leading and trailing yarn ends of said cake to extend from the same end of the cake, applying adhesive means on the exterior surface of said cake, placing a bumper ring about the end of said cake opposite the end whereby said leading and trailing yarn ends extend, placing a cover of heat-shrinkable plastic material about said cake and bumper ring and heat-shrinking said cover tightly about said cake and bumper ring, removing said forming tube thereby leaving a hollow core in said cake, and securing at least one of said yarn ends to the exterior of said heat-shrunk cover for ready accessibility.

16. A method of forming a filamentary yarn cake comprising, winding yarn to form a cake of yarn about a removable forming tube, orienting the leading and trailing yarn ends of said cake to extend from the same end of the cake, applying adhesive means on the exterior surface of said cake, placing a cover of heat-shrinkable plastic material about said cake and heat-shrinking said cover tightly about said cake to completely cover all exposed portions of said wound yarn cake, placing a bumper ring about the end of said cake opposite the end where said leading and trailing yarn ends extend exterior said heat shrunk cover, removing said forming tube thereby leaving a hollow core in said cake, and securing at least one of said yarn ends to the exterior of said heat-shrunk cover for ready accessibility.

17. A method of forming a filamentary yarn cake comprising, winding yarn to form a cake of yarn about a removable forming tube, orienting the leading and trailing yarn ends of said cake to extend from the same end of the cake, applying adhesive means on the exterior surface of said cake, placing a bumper ring about the end of said cake opposite the end where said leading and trailing yarn ends extend, placing a cover of heat-shrinkable plastic material about said cake and bumper ring and heat-shrinking said cover tightly about said cake and bumper ring, removing said forming tube thereby leaving a hollow core in said cake, and securing said leading and trailing yarn ends to the exterior of said heat-shrunk cover for ready accessibility.

18. The method of forming a filamentary yarn cake as defined in claim 17 wherein said step of applying adhesive includes placing a plurality of circumferentially spaced longitudinally disposed strips of double faced pressure sensitive adhesive on said cake.

19. The method of forming a filamentary yarn cake as defined in claim 17 including the step of securing a bumper ring to the other end of said cake over said heat-shrunk cover.

* * * * *